US006776655B2

(12) United States Patent
Krause et al.

(10) Patent No.: US 6,776,655 B2
(45) Date of Patent: Aug. 17, 2004

(54) PLUG CONNECTOR COMPONENT, IN PARTICULAR FOR A COAXIAL PLUG

(75) Inventors: Jens Krause, Rahden (DE); Ludger Leve, Rahden (DE)

(73) Assignee: HARTING Automotive GmbH & Co. KG (DE)

( * ) Notice: Subject to any disclaimer, the term of this patent is extended or adjusted under 35 U.S.C. 154(b) by 0 days.

(21) Appl. No.: 10/300,178

(22) Filed: Nov. 20, 2002

(65) Prior Publication Data

US 2003/0096532 A1 May 22, 2003

(30) Foreign Application Priority Data

Nov. 21, 2001 (DE) ..... 201 18 958 U

(51) Int. Cl.[7] ..... H01R 9/05
(52) U.S. Cl. ..... 439/578
(58) Field of Search ..... 439/578–585

(56) References Cited

U.S. PATENT DOCUMENTS

| | | | | | |
|---|---|---|---|---|---|
| 3,936,132 | A | * | 2/1976 | Hutter | 439/551 |
| 4,045,113 | A | * | 8/1977 | Iacono | 439/578 |
| 5,066,249 | A | * | 11/1991 | Doye et al. | 439/585 |
| 5,322,453 | A | | 6/1994 | Resnick et al. | 439/581 |
| 5,580,261 | A | * | 12/1996 | Meynier | 439/188 |
| 5,704,809 | A | * | 1/1998 | Davis | 439/578 |
| 5,730,623 | A | * | 3/1998 | Krantz et al. | 439/580 |
| 5,857,867 | A | | 1/1999 | Henry | 439/290 |
| 5,993,253 | A | * | 11/1999 | Sai | 439/578 |
| 6,179,656 | B1 | * | 1/2001 | Wong | 439/578 |
| 6,352,448 | B1 | * | 3/2002 | Holliday et al. | 439/585 |
| 6,454,613 | B2 | * | 9/2002 | Valceschini | 439/701 |

FOREIGN PATENT DOCUMENTS

| | | | |
|---|---|---|---|
| DE | 28 41 676 | 9/1978 | H01R/17/12 |
| DE | 38 36 141 A1 | 10/1988 | H01R/9/05 |
| DE | 42 40 556 A1 | 12/1992 | H01R/17/04 |
| DE | 201 09 367 U1 | 6/2001 | H01R/13/502 |
| EP | 0 311 739 | 4/1988 | H01R/17/12 |
| FR | 1300249 | 2/1962 | |
| FR | 1331988 | 9/1965 | H01R/13/645 |
| GB | 1006429 | 9/1965 | |
| JP | 2001-2 30 031 A | 8/2001 | H01R/43/16 |

* cited by examiner

*Primary Examiner*—Michael C. Zarroli
(74) *Attorney, Agent, or Firm*—Hayes Soloway P.C.

(57) ABSTRACT

A plug connector component, in particular for a coaxial plug or an optical plug connector, comprises a substantially cylindrical housing made of an electrically conductive material and constituting an external contact. The plug connector component further comprises an insulating body provided in the interior of the housing and made of plastics, and at least one latching collar on an outside of the housing. The housing has at least one recess, the latching collar is made of plastics and the latching collar and the insulating body are connected in one piece with each other right through the recess.

10 Claims, 4 Drawing Sheets

PLUG CONNECTOR COMPONENT, IN PARTICULAR FOR A COAXIAL PLUG

TECHNICAL FIELD

The invention relates to a plug connector component for a coaxial plug.

BACKGROUND OF THE INVENTION

Conventional plug connector components comprise a substantially cylindrical housing fade of an electrically conductive material and constituting an external contact, an insulating body provided in the interior of the housing and made of plastics, and at least one latching collar on the outside of the housing. This latching collar makes it possible for the plug connector component, i.e. either a socket or a plug, to latch in place in a receptacle. Shoulders and/or latching elements may provided for this purpose in the receptacle. Hitherto, the housings of the plug connector components have been manufactured on lathes; this, however, is expensive.

From German Utility Model 201 09 367 there is known a plug connector component of the type initially mentioned. In this plug connector component, the housing is constituted by first and second housing parts which both are made of a plastically deformed tube section and are put into each other. Here, a suitably formed rim of one of the housing parts forms a latching collar, so that machining a blank may be dispensed with.

It is the object of the invention to further develop a plug connector component of the type initially mentioned to the effect tat it can be produced at even more favorable costs.

BRIEF SUMMARY OF THE INVENTION

According to the invention, a plug connector component comprises a substantially cylindrical housing made of an electrically conductive material and constituting an external contact, The plug connector component further comprises an insulating body provided in the interior of the housing and made of plastics, and at least one latching collar on an outside of the housing. The housing has at least one recess, the latching collar is made of plastics and the latching collar and the insulating body are connected in one piece with each other right through the recess. This design is based on the knowledge that a minimum manufacturing expenditure will be achieved if during injection-molding of the insulating body—which is a necessary step anyway—the latching collar is produced simultaneously. To this end, it is only required in addition to the appropriate design of the molding tool to provide at least one recess in the housing, so that the plastics material can extend right through the housing from the inside of the housing to the outside.

The housing may be formed by a stamped sheet metal strip which is bent into a tubular shape, the latching collar encompassing the housing such that the sheet metal strip is maintained in its tubular shape. In this way the desired configuration of the housing can be realized with low expenditure.

Preferably it is provided for that the housing is formed by a plastically deformed tube section. Since a closed cross-section is used for the housing, there will be obtained improved RF characteristics in addition to a higher mechanical strength. The tube section can be brought into the desired shape with low expenditure by means of upsetting, rolling or chasing etc. The recess is preferably stamped out.

A CuZn alloy is preferably used for the housing. Polystyrene, polypropylene or another material having good RF characteristics may be used for the insulating body.

Further advantages of the invention will be apparent from the subclaims.

DETAILED DESCRIPTION OF THE PREFERRED EMBODIMENTS

Figure 1:
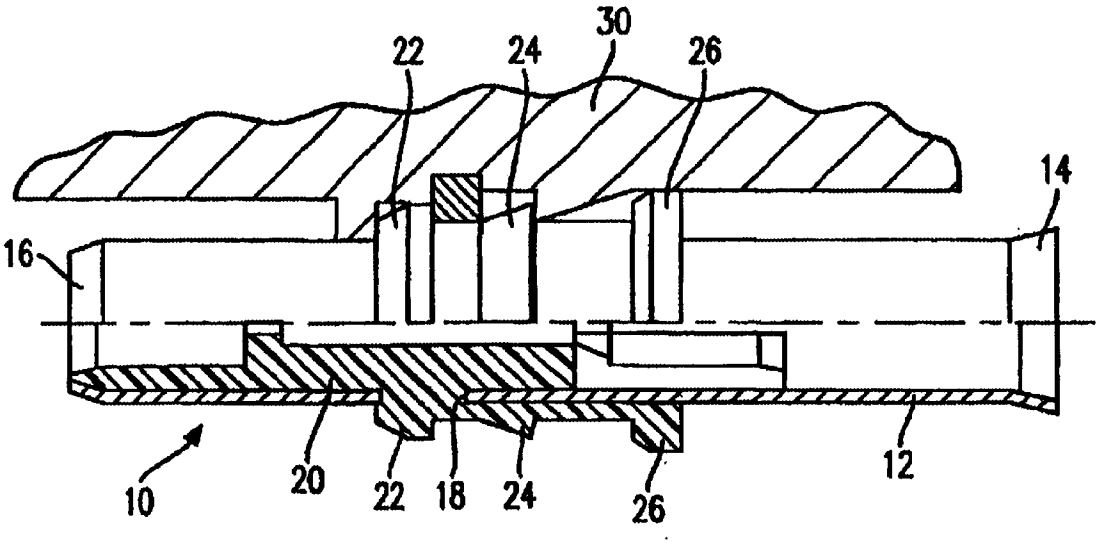
FIG. 1 shows in a schematic, partial sectional side view a plug connector component according to a first embodiment, configured as a plug and arranged in a schematically indicated receptacle.
Figure 3:
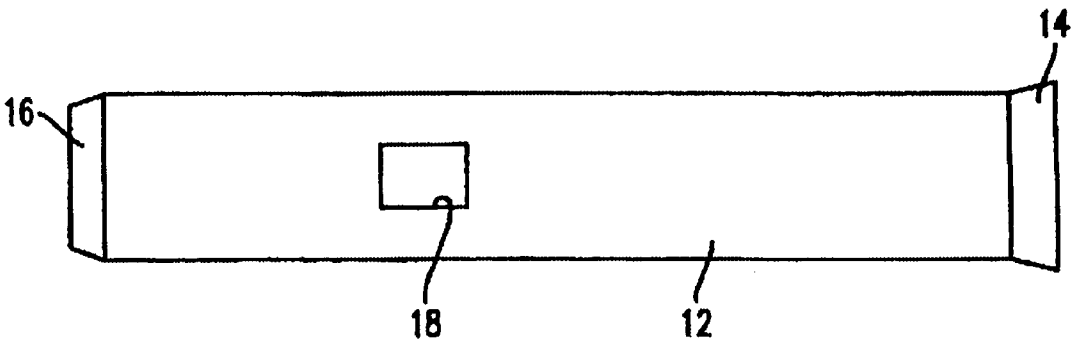
FIG. 3 shows in a schematic sectional side view the housing of the plug connector component of FIG. 1, in a condition before the latching collar and the insulating body have been attached by injection-molding.
Figure 2:
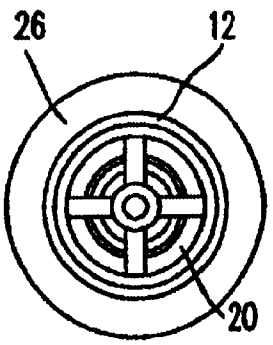
FIG. 2 shows the plug connector component of FIG. 1 in a rear view.

In FIGS. 1 and 2 there is shown a plug connector component 10 according to a first embodiment and configured as a plug. It has a substantially cylindrical housing 12 (see FIG. 3) which is made of metal. In the embodiment shown here, the housing 12 is produced starting from a tube section which has been cut to an appropriate length and has been upset subsequently. In this way, there is formed a conical widening 14 at the right-hand, rear end with respect to FIG. 1; at the front end there is formed a lead-in cone 16. In the envelope surface of the substantially cylindrical housing 12 there are formed two diametrically opposed recesses 18 which may have been made by stamping. However, it is likewise possible to use a plurality of recesses distributed across the circumference of the housing.

Arranged in the interior of the housing 12 is an insulating body 20 made of plastics. At a later point in time, an internal contact will be arranged in the insulating body, so that a coaxial plug is produced.

Formed on the outside of the housing 12 are first, second, and third latching collars 22, 24, 26 which likewise are made of plastics. The three latching collars 22, 24, 26 are formed in one piece with each other and also in one piece with the insulating body 20, because the plastics material from which they are formed extends right through the recess 18 from the inside of the housing 12 to the outside. The insulating body 20 and the three latching collars 22, 24, 26 are injection-molded in one single operation so that other than in prior art an additional mounting step is not required. The three latching collars 22, 24, 26 serve for positioning and arresting the plug connector component 10 in a schematically indicated receptacle 30 into which a complementary plug connector can be inserted, i.e., a socket as is shown in FIGS. 4 and 5.

Figure 5:
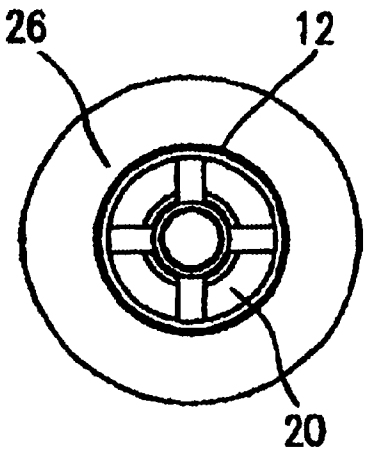
FIG. 5 shows the plug connector component of FIG. 4 in a rear view.
Figure 4:
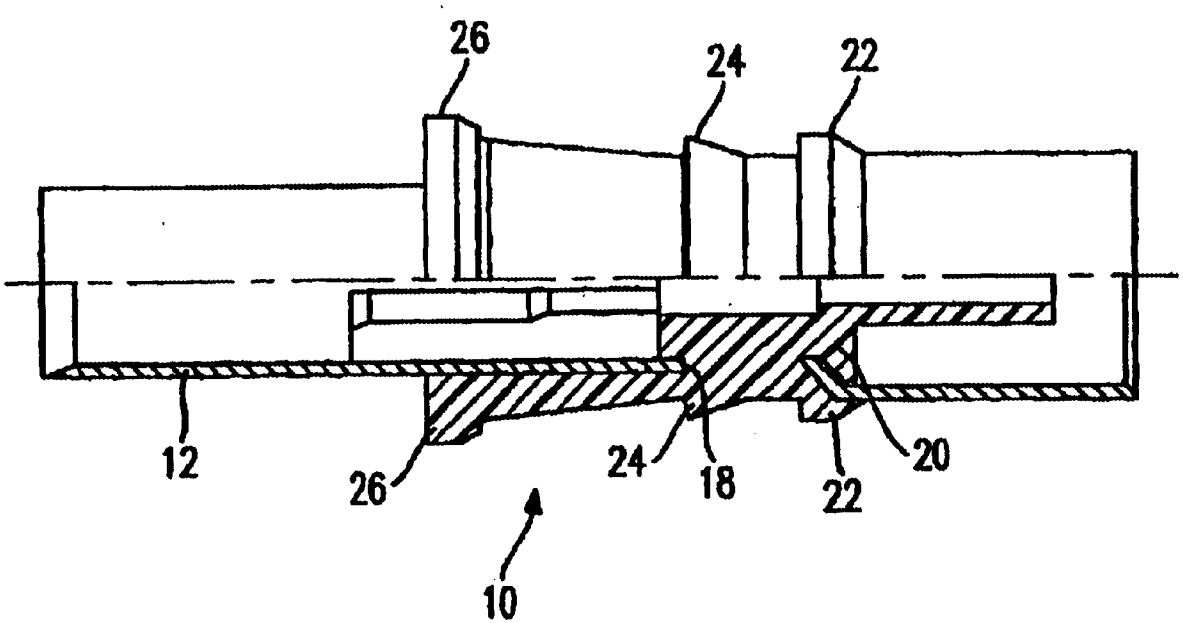
FIG. 4 shows in a schematic, partial sectional side view a plug connector component configured as a socket.

The socket shown in FIGS. 4 and 5 has the same construction as the plug shown in FIGS. 1 and 2, i.e. is constituted by a housing 12 with an insulating body 20 arranged in the interior space of which. Three latching collars 22, 24, 26 are formed on the outside of the housing 12. These collars, in turn, are formed in one piece with the insulating body 20. The three latching collars serve for arresting the socket in the receptacle 28 if it is inserted in the plug arranged there.

Figure 6:
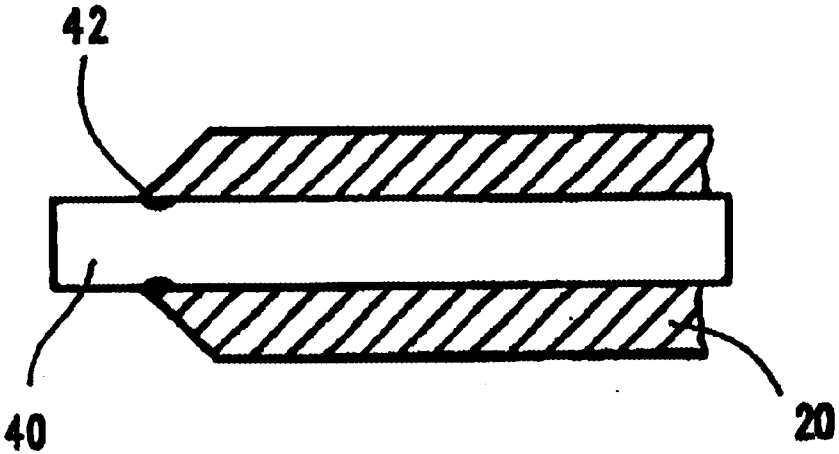
FIG. 6 shows a plug connector component according to a second embodiment for receiving an optical waveguide.

In FIG. 6 there is shown in a broken view a plug connector component according to a second embodiment. Unlike the first embodiment, an optical waveguide 40 is arranged in the interior of the insulating body here. To this end, only the diameter of the central bore of the insulating body 20 has to be matched with the diameter of the sheathing of the optical waveguide 40.

In order to ensure for an optimized signal transmission to a mating connector that the optical waveguide is well centered, there is provided in the central bore on the plug side a centering means in the form of narrowed portion 42 of the insulating body 20.

Figure 7:
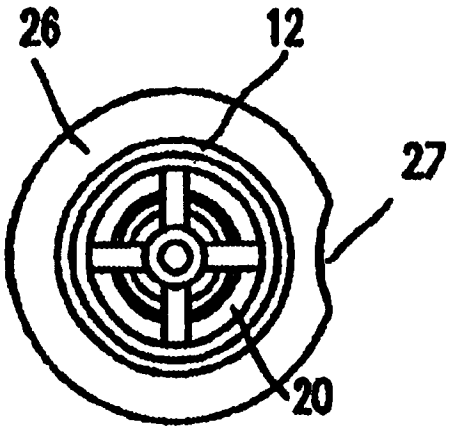
FIG. 7 shows a plug connector component with mechanical coding means.

In FIG. 7 there is illustrated a plug connector component which is provided with coding means in the form of coding recesses 27 in the latching collars 22, 24, 26. In this arrangement, thee may be formed recesses of any shape which can be realized by injection-molding; depending on the case of application and the shaping of the mating connector, these recesses may be arranged as desired on any of the three latching collars, but preferably in latching collar 26.

Figure 8:
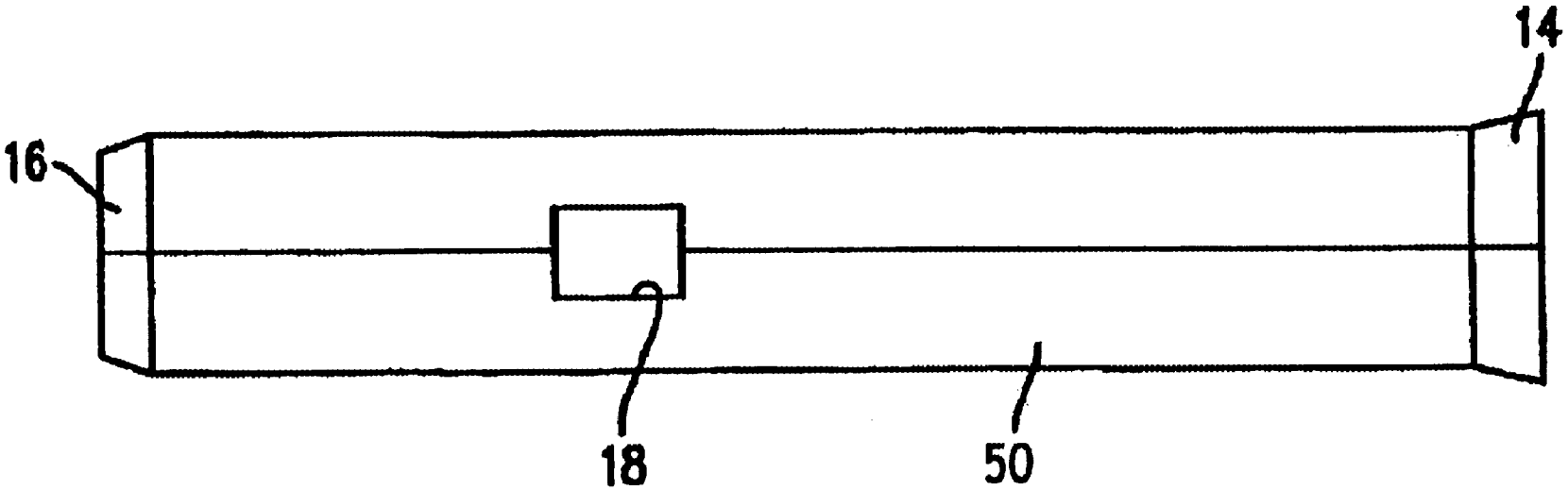
FIG. 8 is a view similar to FIG. 3, showing a housing component according to yet another embodiment.

In FIG. 8 is illustrated a housing 50 in accordance with another embodiment of the invention in which the housing is formed by a sheet metal strip which has been stamped and bent into a tubular shape. In such embodiment the latching collar encompassing the housing also serves to maintain the housing in its tubular shape.

What is claimed is:

1. A plug connector component, in particular for a coaxial plug or an optical plug connector, said plug connector component comprising a substantially cylindrical housing made of an electrically conductive material and constituting an external contact, an insulating body provided in an interior of said housing and made of plastics, and at least one latching collar on an outside said housing, wherein said housing has at least one recess, said latching collar is made of plastics and said latching collar and said insulating body comprise a unitary construction connected through said recess.

2. The plug connector component according to claim 1, wherein said housing is formed from a plastically deformed tube section.

3. The plug connector component according to claim 2, wherein said housing comprises two conically deformed ends.

4. The plug connector component according to claim 1, wherein said housing is formed by a sheet metal strip which has been stamped and bent into a tubular shape.

5. The plug connector component according to claim 4, wherein said latching collar encompasses said housing such that said sheet metal strip is maintained in its tubular shape.

6. The plug connector component according to claim 1, wherein two diametrically opposed recesses are provided.

7. The plug connector component according to claim 1, wherein said insulating body is formed from a plastics material.

8. The plug connector component according to claim 1, wherein said insulating body has a centering means for receiving an optical waveguide.

9. The plug connector component according to claim 1, and further comprising mechanical coding means formed in said latching collar.

10.The plug connector component according to claim 7, wherein said plastics material is selected from polystyrene and polypropylene.

* * * * *